US006110512A

United States Patent [19]

Teasdale et al.

[11] Patent Number: 6,110,512

[45] Date of Patent: Aug. 29, 2000

[54] PACKAGE AND MERCHANDISER

[75] Inventors: Arthur C. Teasdale, Sun Prairie; Stephen P. Wilcox, Waunakee, both of Wis.

[73] Assignee: Kraft Foods, Inc., Northfield, Ill.

[21] Appl. No.: 09/199,517

[22] Filed: Nov. 25, 1998

[51] Int. Cl.[7] ..... B65D 85/00

[52] U.S. Cl. ..... 426/121; 426/110; 426/122; 426/124; 426/115; 426/119; 426/396; 426/398; 426/410; 229/115; 229/116

[58] Field of Search ..... 426/115, 119, 426/124, 110, 121, 122, 410, 396, 398, 411; 229/115, 116

[56] References Cited

U.S. PATENT DOCUMENTS

| | | | |
|---|---|---|---|
| D. 192,618 | 4/1962 | Bush . | |
| D. 197,147 | 12/1963 | Shapiro . | |
| 715,442 | 12/1902 | Van Horn . | |
| 3,339,721 | 9/1967 | Goldstein . | |
| 4,125,633 | 11/1978 | Vander Lugt, Jr. | 426/411 |
| 4,734,288 | 3/1988 | Engstrom et al. . | |
| 4,784,864 | 11/1988 | Ikeda . | |
| 5,026,563 | 6/1991 | Van Erden et al. | 426/121 |
| 5,083,700 | 1/1992 | Mello et al. . | |
| 5,295,630 | 3/1994 | Parish . | |
| 5,400,955 | 3/1995 | Coalier et al. | 229/108 |
| 5,437,406 | 8/1995 | Gordon et al. . | |
| 5,716,473 | 2/1998 | Gordon et al. . | |

*Primary Examiner*—Gabrielle Brouillette
*Assistant Examiner*—Hao Mai
*Attorney, Agent, or Firm*—Cook, Alex, McFarron, Manzo, Cummings & Mehler Ltd

[57] ABSTRACT

Packaging for food products is provided which combines a flexible pouch within a stand-up tent-style carton which effects display of the product in an upright orientation within a divided merchandiser. The carton has a non-uniform width. The bottom portion of the carton is narrower than the top portion of the carton, as a result of which the carton, and thus the entire package, complies with a very strict display face dimension limit of the merchandiser.

19 Claims, 5 Drawing Sheets

PACKAGE AND MERCHANDISER

BACKGROUND OF THE INVENTION

This invention generally relates to packaging for food products, especially food product strips. More particularly, the packaging combines a food-containing flexible pouch within a tent-style carton. While the flexible pouch has a width which is consistent along its height, the tent-style carton is not uniform in width along its height. Instead, the tent-style carton is wider along its top portion than along its bottom portion. This allows the combination pouch and carton to maintain display space size commonality with the pouch itself in order to accommodate the combination carton and pouch into upright display merchandisers for packaged products which do not include the carton.

Upright display merchandisers for food products have very strict display face dimension limits. In order to avoid wasting space, the width of each product must divide evenly into the total shelf facing width. For example, a shelf having a total facing width of 48 inches will evenly accommodate six rows of food packages if those rows each fit within a maximum facing width of eight inches. Of course, a width not much less than eight inches is also desired in order to make maximum use of the available space. What cannot be tolerated in this situation, however, is having the food package require even only slightly more than eight inches of lateral shelf space or merchandiser facing width.

In order to avoid disruption of neighboring packages when a package is removed from one row, a typical upright display merchandiser has a plurality of demarcation members which specifically define the respective rows. These can take the form of self-contained organizers. In their simplest form, these demarcation members take the form of dividers which are positioned at each evenly spaced location along the length of the shelf. In the example of the merchandiser shelf which has a total facing width of 48 inches, each such divider or wall would be spaced every eight inches (on centers) in order to accommodate six rows of packages. In this instance, pouches are sized to fit within the available space, which is less than eight inches in view of the thickness of the dividers. Accordingly, the pouches are sized to fit within the available space. The flexibility of the pouches provides some extra accommodation to these size constraints, especially with respect to the lower portions of the pouches which do not have extra bulk and/or stiffness typically associated with closure members at the top portion of the pouch. The advantage of this accommodative aspect of flexible pouches is forfeited when the pouch is placed within an outer carton which maintains its dimensions unless subjected to extraordinary and damaging forces.

In most upright display merchandiser situations, package depth also is limited. Because of this, it is often not possible to make a packaged product which is narrower and proportionally deeper in order to accommodate the same weight of food product in a narrower package. In addition, for economic, capital equipment and convenience reasons, a manufacturer will have a strong preference for using the same pouch size, whether intended for a pouch-only package or for a package having the pouch positioned within a carton.

This accommodation issue is rendered more difficult when the upper portion of the pouch designed for gaining access to the food product includes a strip such as a zipper-type strip which permits access into and reclosure of the pouch cavity. Strips of this type significantly decrease flexibility of the upper portion of the pouch. They often also add thickness to the pouch, requiring a greater volume in order to accommodate the strip, such as between opposing panels of a carton. Because of this added bulk and stiffness, the external dimensions of a strip-containing upper portion of a pouch must be maintained and slightly exceeded in the combination package so that the strip-containing upper portion of the pouch is comfortably enclosed fully within the top portion of the package.

The present invention addresses the difficulties and concerns which occur when a pouch which is designed to maximize space available in an upright display merchandiser is to be made available in a combined package wherein the pouch is positioned within a non-flexible carton which is rigid or semi-rigid, at least in a longitudinal orientation. These difficulties and concerns are addressed without having to modify the size or shape of the pouch or the weight, sizing and orientation of the food within the pouch.

SUMMARY OF THE INVENTION

In accordance with the present invention, a food package is provided which combines a food-containing flexible pouch with a tent-style carton within which the pouch is contained. The flexible pouch has a reclosure strip along a top portion of the pouch, and the top portion of the tent-style carton encloses and supports this top portion of the pouch. The lower portion of the carton has a width which is less than the upper portion of the carton which accommodates and encloses the top portion of the flexible pouch. In the preferred embodiment, the tent-style carton has a generally tapered configuration.

It is accordingly a general object of the present invention to provide an improved food package combination of a food-containing flexible pouch and a tent-style carton enclosing the flexible pouch.

Another object of the present invention is to provide an improved pouch and carton combination which maintains display facing size commonality with a substantially identical pouch having the same contents. Another object of this invention is to provide an improved food package combination of a food-containing flexible pouch and a tent-style carton, wherein the flexible pouch has a reclosure zip strip, and the carton accommodates and closely holds the portion of the pouch having the reclosure strip.

These and other objects, features and advantages of the present invention will be apparent from and clearly understood through a consideration of the following detailed description.

BRIEF DESCRIPTION OF THE DRAWINGS

In the course of this description, reference will be made to the attached drawings, wherein.

DESCRIPTION OF THE PREFERRED EMBODIMENTS

Figure 1:
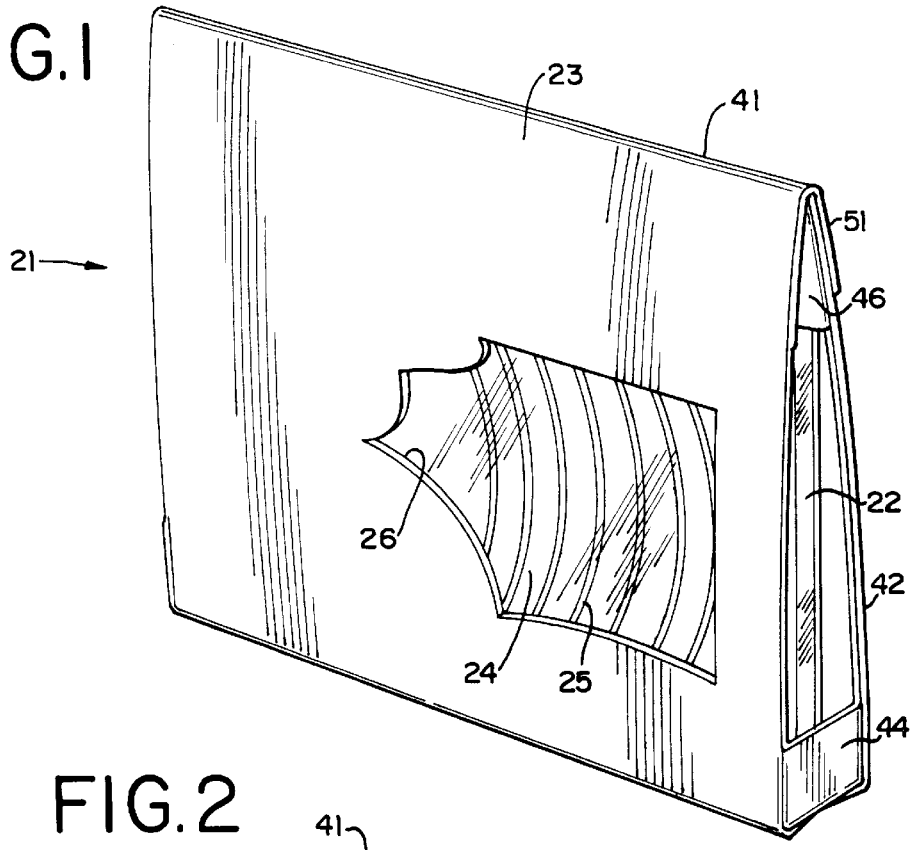
FIG. 1 is a perspective view of the combined pouch and carton according to the invention, showing a sliced product.

A preferred combination of the package according to the invention is generally illustrated at 21 in FIG. 1 and elsewhere. A flexible pouch 22 is shown positioned within a tent-style carton 23. Food product 24 is shown within the flexible pouch 22. A plurality of slices 25 of the food product are illustrated. The food items can be slices, strips, cubes, dices or shreds of luncheon meat, whole muscle meat, cold cuts, cheese, and the like. In the embodiment illustrated in FIGS. 1, 2 and 6, slices 25 are shown, and they are shown shingled such that slices are horizontally offset from adjacent slices. In order to permit the potential purchaser and consumer to view the food product prior to purchasing, the flexible pouch 22 is generally transparent, and one or more windows 26 and/or 27 (FIG. 3) can be provided. In this illustrated embodiment, one side of each slice is visible through the front window 26, which is depicted as an example, while less than all of the slices are visible through the rear window 27.

With further reference to the flexible pouch 22, a strip 28 (FIG. 6) is positioned along an access opening 29 into the product cavity 31 of the flexible pouch, the food product 24 being within this product cavity 31. It will be appreciated, in accordance with known practices, that the bottom edge portion 32 and the side edge portions 33, 34 are seals which substantially permanently join the front panel 35 of the pouch to its rear panel 36. Strip 28 allows for selective opening and reclosing of the flexible pouch in order to provide for easy removal of a portion or all of the food product from the product cavity 31. A typical strip having these reclosure attributes is a so-called zipper strip, which may take on any one of various structures. For example, a zipper strip can comprise elongated profiles which are complementary in shape such that one profile is received into the other profile. Other reclosure strips include slidable components. Specific details of the strip 28 will be appreciated by those of ordinary skill in the art of flexible pouches. Whatever the exact structure, strip 28 has a stiffness and a bulkiness or thickness which are greater than the stiffness and bulkiness of the remainder of the flexible pouch 22 itself.

Figure 4:
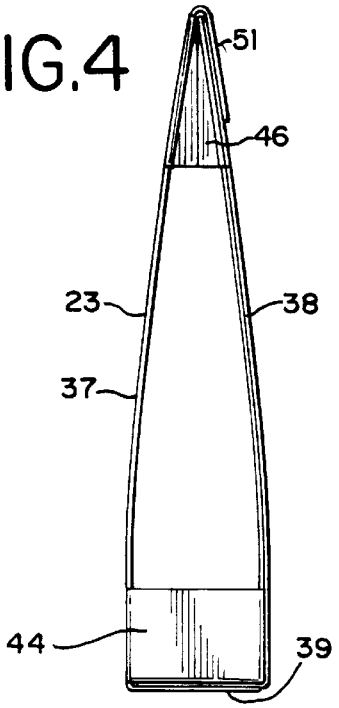
FIG. 4 is an end view of the tent-style carton shown in the FIG. 1 embodiment.

Tent-style carton has a front face 37, a back face 38, and a bottom face 39. Also included is a top edge 41. Respective edges of the front face 37, the back face 38, the bottom face 39 and the top edge combine to delineate a pair of opposing end areas 42, 43, each of which has a generally triangular configuration as generally shown in FIG. 4 and in FIG. 5. In the illustrated embodiment, partial end panels 44, 45 are included. The height of these end panels can vary as desired.

Figure 6:
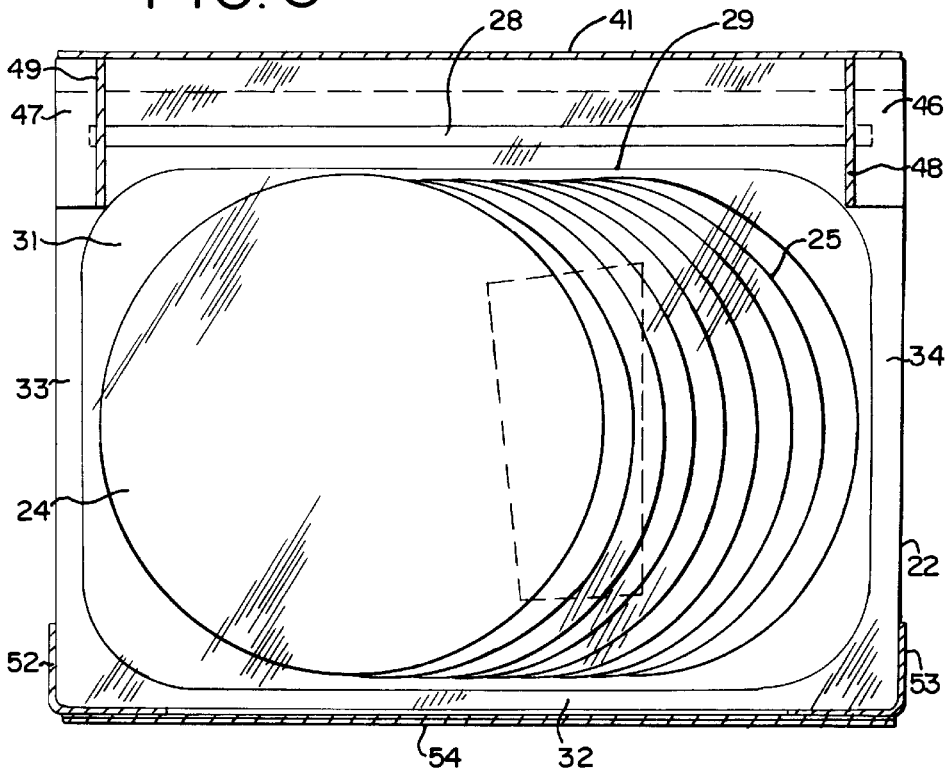
FIG. 6 is a transverse, vertical cross-section of the embodiment shown in FIG. 1, with the pouch component being shown in elevation.
Figure 7:
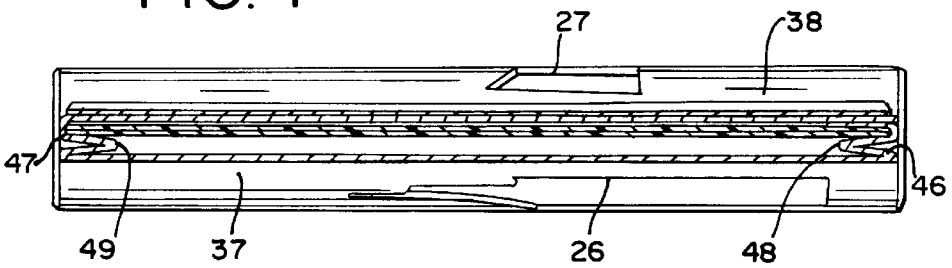
FIG. 7 is a transverse, horizontal cross-section through the embodiment of FIG. 1.

With further reference to the tent-style configuration of the carton 23, gussets 46, 47 are provided at the upper portion of the carton at its opposing ends. Each gusset is comprised of a reentrant fold portion of the carton material having a respective fold line 48, 49 (FIG. 6 and FIG. 7). As is generally known in the art, this gusset and reentrant fold structure contributes to the formation of the tent-style carton which is generally shown in the drawings.

Figure 5:
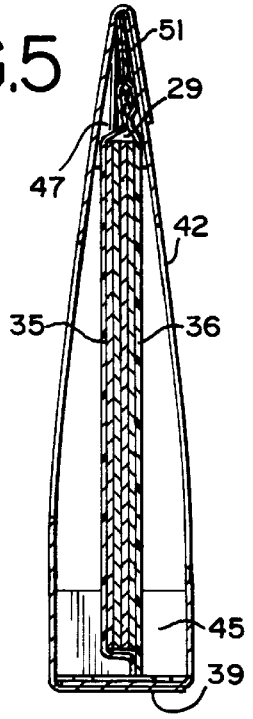
FIG. 5 is a vertical cross-sectional view through the embodiment of the package shown in FIG. 1.

As is perhaps best seen in FIGS. 5, 6 and 7, reentrant fold gussets 46 and/or 47, and especially one or both of their respective fold lines 48, 49, engage a top portion of the pouch in order to help maintain the position of the pouch within the combination package. In the illustrated embodiment, this upper pouch portion includes the strip 28. The stiffness and bulkiness of the strip 28 are accommodated by the reentrant fold gussets 46 and/or 47 in a manner such that one or both of these gusset portions captures and grasps an end portion of the strip 28. In the arrangement shown in FIGS. 5, 6 and 7, the top portion of the flexible pouch is positioned between one wall of the reentrant fold gusset and the inside surface of the carton panel having the back face 38 of the tent-style carton 23. Without this arrangement, the flexible pouch 22 could sag within the tent-style carton 23, especially in view of the presence of the food product 24 within the flexible pouch. The tent-style configuration is completed by having overflap 51 secured to the back face 38 by any suitable means such as a glue or an adhesive.

In an important aspect of the present invention, the lower portion of the tent-style carton 23 has a width $W_L$, while the upper portion of the tent-style carton has a width $W_U$. Lower portion width $W_L$ is less than upper portion width $W_U$. In the preferred embodiment which is illustrated, this difference in widths is achieved by providing gradually tapering opposing end areas 42, 43.

Figure 2:
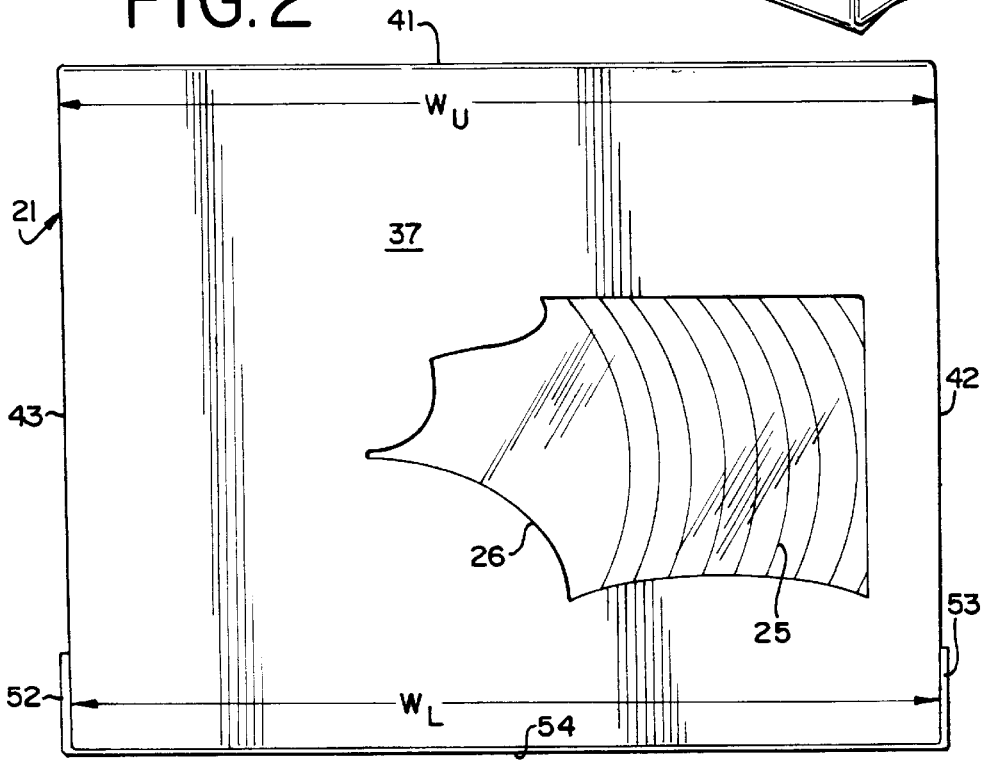
FIG. 2 is a front elevation view of the embodiment shown in FIG. 1.
Figure 3:
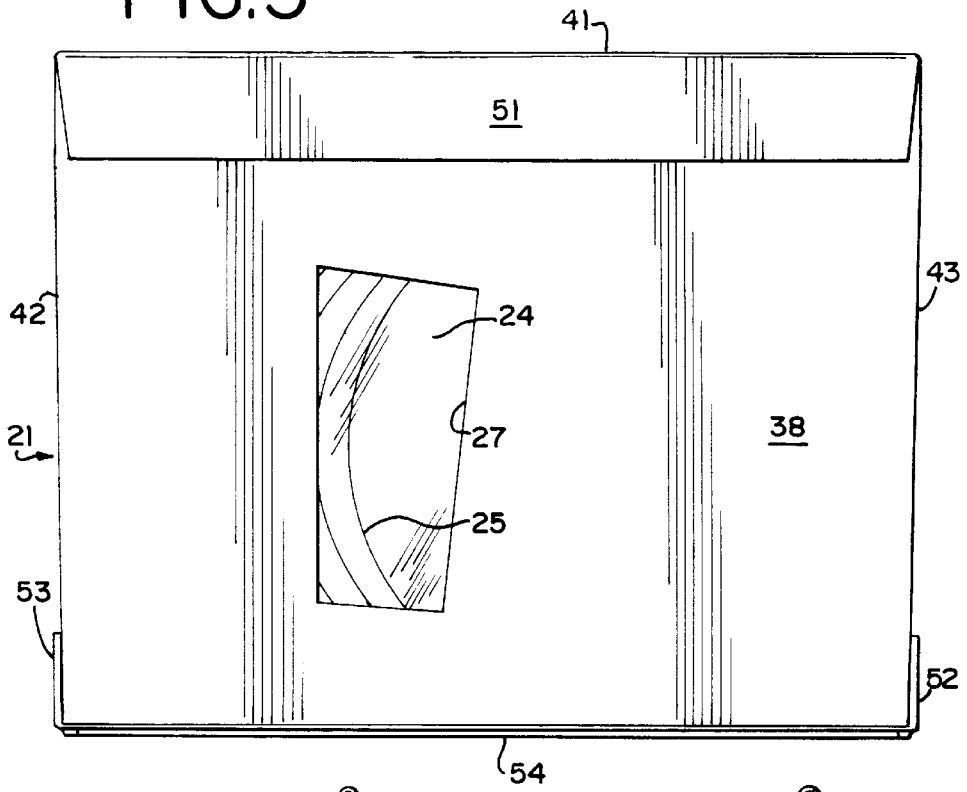
FIG. 3 is a rear elevational view of the embodiment shown in FIG. 1.

FIGS. 2, 3 and 6 illustrate a merchandiser structure which is typical of many current retail facilities. Included are a plurality of low walls or dividers 52, 53, each being parallel to the other. A bottom panel 54 is also shown. Spacing between dividers 52 and 53 (typically on centers) represents the spacing of an existing merchandiser, such as a merchandiser suitable for storing and displaying food packages which are sized and shaped according to the size and shape of flexible pouch 22. The package combination 21 in accordance with the invention maintains display space size commonality with the display space of the pouch component size and shape. The facing width required by the package combination 21 is the same as that of the flexible pouch 22. Thus, the pouch is supported and protected by a generally rigid tent-style carton, with its attendant substantial surface area upon which indicia, product information, promotional displays, and the like can be presented. The presentation is advantageous in that the product is attractively displayed to enhance appetite appeal.

This advantageous combination is provided in accordance with the present invention without the need to adjust merchandiser sizing and without having to design a differently sized or configured flexible pouch. Width $W_L$ of the tent-style carton 23 closely fits within the facing spacing between the inside faces of the dividers 52 and 53. This spacial relationship can assist in properly positioning the package combination 21 within the merchandiser, typically also assisting in maintaining vertical support of the packages 21.

Figure 8:
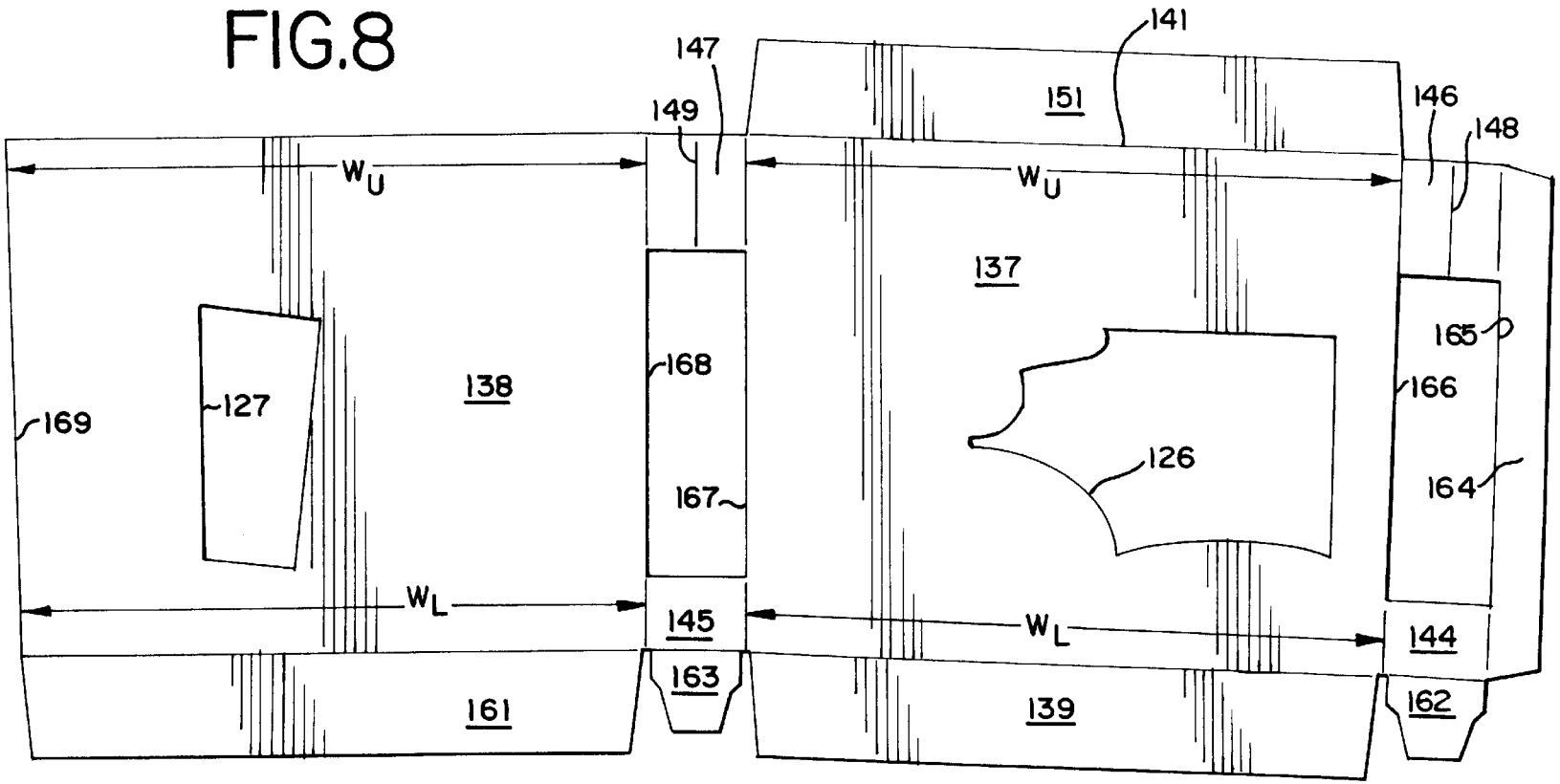
FIG. 8 is a plan view of a blank for making the carton as shown in the FIG. 1 embodiment.

Turning now to FIG. 8, a blank is shown which can be used to construct the tent-style carton 23 which is shown in FIG. 1. Illustrated blank includes a front face panel portion 137 having a window 126, as well as a back face panel portion 138 having a window 127. A bottom panel portion 139 is provided for folding over an inside bottom flap portion 161, as well as inside end flap portions 162 and 163. Portions 139, 161, 162 and 163 are positioned so as to be folded and joined into the bottom portion of the tent-style carton which is made from this blank. Gusset portions 146 and 147, having fold lines 148 and 149, are provided to form the gusset of the tent-style carton, with the overflap portion 151 having a fold line 141 which coincides with the top edge 41 of the assembled tent-style carton 23. An assembly flap portion 164 of the blank is provided for secure attachment to the inside surface of the back face panel portion 138 in the finished tent-style carton.

In this illustrated embodiment, the lower portion of each of the front face panel portion 137 and the back face panel portion 138 are at the length $W_L$ as discussed else herein. Similarly, each of the upper portions of the front face panel portion 137 and of the back face panel portion 138 have a width $W_U$ as generally discussed herein. Width $W_L$ is less than $W_U$ as generally discussed herein. Width $W_L$ is less than width $W_U$ in each instance, and edges 165, 166, 167, 168 and 169 are not at right angles to the fold lines of the bottom panel portion 139, the overflap 151 and the inside bottom flap portion 161.

Figure 9:
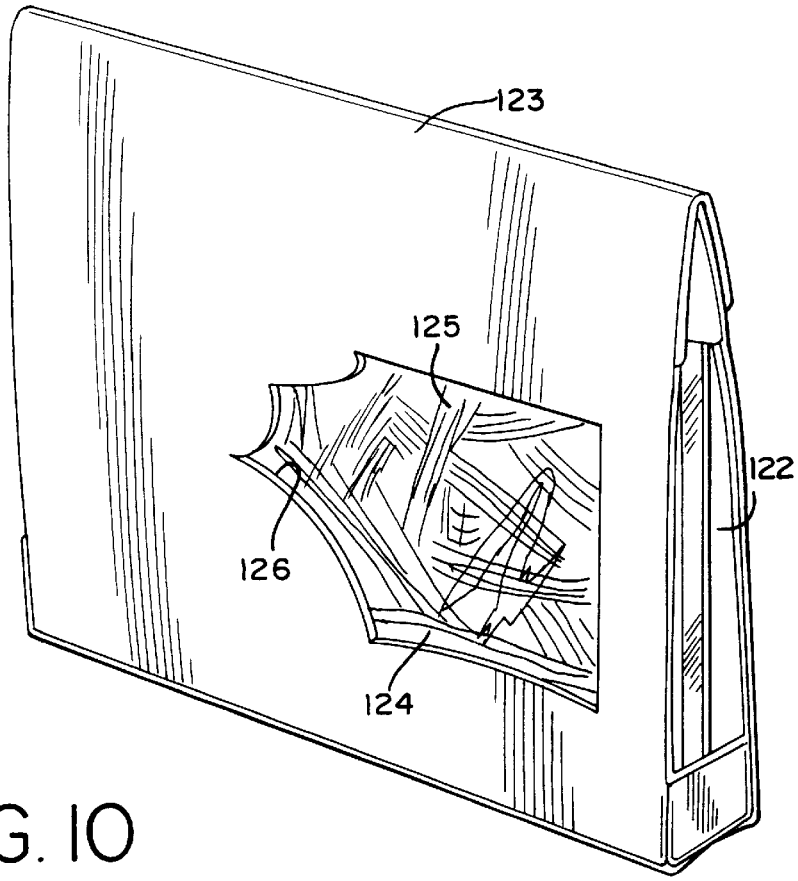
FIG. 9 is a perspective view of a combined pouch and carton, showing a product of a plurality of strips.
Figure 10:
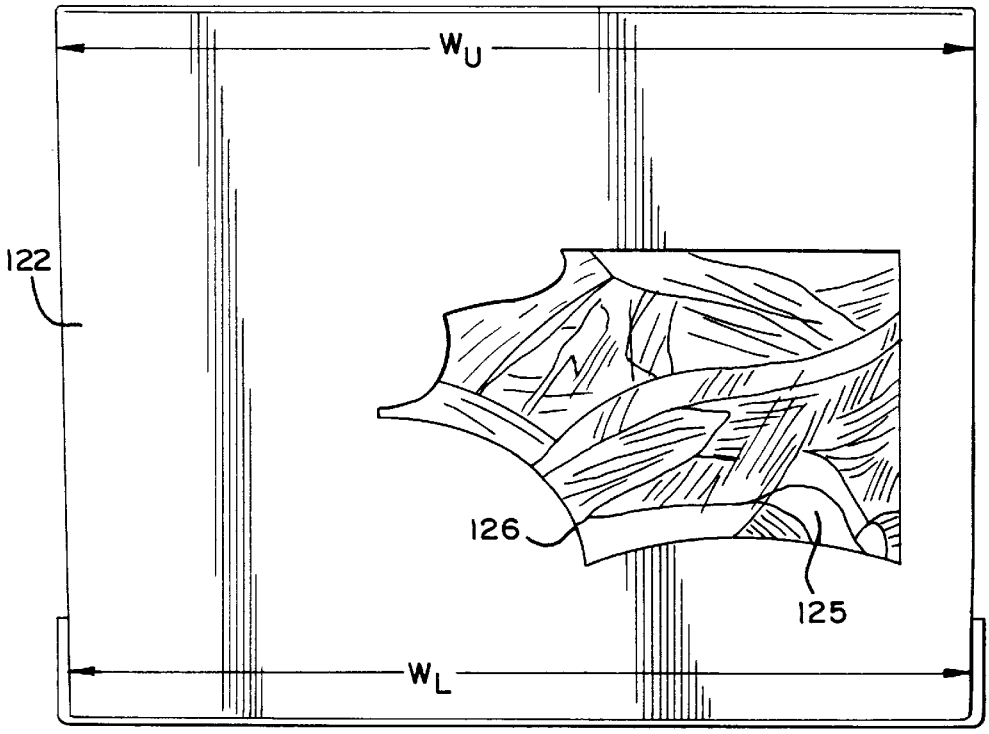
FIG. 10 is a front elevational view of the embodiment shown in FIG. 9.

FIGS. 9 and 10 show a flexible pouch 122 positioned within a tent-style carton 123. Food product 124 is shown within the flexible pouch. A plurality of strips 125 of the food product are illustrated. These strips are in an array which is generally random, and many of the strips 125 are visible through at least front window 126. Strips can be, for example, strips of chicken breast meat.

It will be understood that the embodiments of the present invention which have been described are illustrative of some of the applications of the principles of the present invention. Numerous modifications may be made by those skilled in the art without departing from the true spirit and scope of the invention.

What is claimed is:

1. In the combination of a package and a merchandiser for displaying the package, in which the merchandiser includes a bottom panel and a plurality of dividers with the dividers being parallel to each other and substantially perpendicular to the bottom panel, and the dividers defining a merchandiser facing width therebetween, and the package is a generally inflexible carton having a front face, a back face, a bottom edge, and a top edge, and wherein the improvement comprises:

said front face and back face of the carton having a width $W_U$ at its said top edge, and having a width $W_L$ at its said bottom edge; and said merchandiser facing width is less than said width $W_U$, and said width $W_L$ is not greater than said merchandiser facing width.

2. The combination in accordance with claim 1, wherein said carton is a tent-style carton wherein said faces and edges are oriented with respect to each other to delineate opposing end areas of said carton which are of a generally triangular configuration.

3. The combination in accordance with claim 2, including a flexible pouch within said tent-style carton, and a food product sealed within said flexible pouch.

4. The combination in accordance with claim 3, wherein said flexible pouch has a front panel, a rear panel, a bottom edge portion, and side edge portions sealing together said front panel and said rear panel to provide a product cavity; said flexible pouch having an access opening into said product cavity, said access opening being generally at a top portion of the flexible pouch; a strip at said top edge portion of the flexible pouch, said strip providing selective opening and closing for said access opening; and wherein said food product is removable, in whole or in part, from said flexible pouch through said access opening when said strip is open.

5. The combination in accordance with claim 4, wherein at least one of said opposing end areas of generally triangular configuration includes a reentrant fold gusset portion having a reentrant face, said reentrant face and a portion of said carton directly opposite to said reentrant face provide a gripping section of said carton portion, and wherein said top portion of the flexible pouch is engaged by said gripping section of the carton.

6. The combination in accordance with claim 5, wherein said gripping section of the carton engages said top portion of the flexible pouch so as to prevent movement of said flexible pouch and carton with respect to each other during retail display.

7. The combination in accordance with claim 1, including a flexible pouch within said carton, and a food product sealed within said flexible pouch.

8. The combination in accordance with claim 7, wherein said flexible pouch has a front panel, a rear panel, a bottom edge portion, and side edge portions sealing together said front panel and said rear panel to provide a product cavity; said flexible pouch having an access opening into said product cavity, said access opening being generally at a top portion of the flexible pouch; a strip at said top edge portion of the flexible pouch, said strip providing selective opening and closing for said access opening; and wherein said food product is removable, in whole or in part, from said flexible pouch through said access opening when said strip is open.

9. The combination of claim 6, wherein said food product comprises a plurality of pieces of food product, which pieces are positioned in an array, wherein said rear face of the carton has a window, and wherein at least some of said food product pieces are visible through said window and said flexible pouch.

10. The combination in accordance with claim 8, wherein said width $W_U$ accommodates said top portion and strip of the flexible pouch in a fully flat condition, and said width $W_L$ is inadequate in size to accommodate said top portion and strip of the flexible pouch.

11. The combination in accordance with claim 7, wherein said food product comprises a plurality of food pieces which are slices, and said slices are offset with respect to each other so as to present a shingled array of said food slices.

12. The combination in accordance with claim 11, wherein at least a portion of said flexible pouch is substantially transparent, wherein at least one of said front face and rear face of the carton has a window, and wherein at least some of said shingled food product slices are visible through said window and said flexible pouch.

13. The combination in accordance with claim 8, wherein said strip is a zipper strip having a plurality of opposing interlocking profiles.

14. The combination in accordance with claim 13, wherein said width $W_U$ accommodates said top edge portion and strip of the flexible pouch in a fully flat condition, and said width $W_L$ is inadequate in size to accommodate said top portion and strip of the flexible pouch.

15. The combination in accordance with claim 3, wherein said food product comprises a plurality of pieces of food product, which pieces are positioned in an array, wherein said back face of the tent-style carton has a window, and wherein at least some of said food product pieces are visible through said window and said flexible pouch.

16. The combination in accordance with claim 3, wherein at least one of said opposing end areas of generally triangular configuration includes a reentrant fold gusset portion having a reentrant face, said reentrant face and a portion of said tent-style carton directly opposite to said reentrant face provide a gripping section of said carton portion, and wherein said top portion of the flexible pouch is engaged by said gripping section of the tent-style carton.

17. The combination in accordance with claim 16, wherein said gripping section of the tent-style carton engages said top portion of the flexible pouch so as to prevent movement of said flexible pouch and tent-style carton with respect to each other during retail display.

18. The combination in accordance with claim 1, wherein width $W_U$ is greater than said merchandiser facing width, and wherein said merchandiser facing width accommodates said width $W_L$ and does not accommodate said width $W_U$.

19. The combination in accordance with claim 3, wherein said width $W_U$ accommodates said top portion and strip of the flexible pouch in a fully flat condition, and said width $W_L$ is inadequate in size to accommodate said top portion and strip of the flexible pouch.

* * * * *

UNITED STATES PATENT AND TRADEMARK OFFICE

CERTIFICATE OF CORRECTION

PATENT NO. : 6,110,512
DATED : August 29, 2000
INVENTOR(S) : Teasdale et al.

It is certified that error appears in the above-identified patent and that said Letters Patent is hereby corrected as shown below:

Column 7,
Line 4, delete "1" and insert -- 3 --.

Signed and Sealed this

Twelfth Day of March, 2002

*Attest:*

*Attesting Officer*

JAMES E. ROGAN
*Director of the United States Patent and Trademark Office*